United States Patent [19]

Bosch et al.

[11] Patent Number: 4,914,350

[45] Date of Patent: Apr. 3, 1990

[54] PICTURE DISPLAY DEVICE WITH INTERFERENCE SUPPRESSION MEANS

[75] Inventors: Gerrit Bosch; Tjebbe R. Pasma; Albertus A. S. Sluyterman, all of Eindhoven, Netherlands

[73] Assignee: U.S. Philips Corporation, New York, N.Y.

[21] Appl. No.: 310,805

[22] Filed: Feb. 14, 1989

Related U.S. Application Data

[63] Continuation-in-part of Ser. No. 145,651, Jan. 13, 1988, which is a continuation of Ser. No. 919,910, Oct. 16, 1986, abandoned.

[30] Foreign Application Priority Data

Oct. 25, 1985 [NL] Netherlands ..... 8502918
Sep. 23, 1986 [NL] Netherlands ..... 8602397

[51] Int. Cl.[4] ..... H01J 29/06
[52] U.S. Cl. ..... 315/8; 315/85; 335/214

[58] Field of Search ..... 315/8, 85, 149, 370, 315/371; 335/213, 214

[56] References Cited

U.S. PATENT DOCUMENTS 2,994,803 8/1961 Goldberg ..... 315/8
3,879,633 4/1975 Stark ..... 315/8
4,634,930 1/1987 Toshiyasu ..... 315/8

*Primary Examiner*—Donald J. Yusko
*Assistant Examiner*—Brian S. Palladino
*Attorney, Agent, or Firm*—Michael E. Marion

[57] ABSTRACT

Picture display device having a display tube and a deflection unit comprising a field deflection coil and a line deflection coil. To comply with a predetermined interference radiation standard, the picture display device is provided with one interference suppression coil or system of interference suppression coils is orientated and can be energized in such a manner that, measured at a predetermined distance from the picture display device, the strength of the dipole component is below a desired standard.

4 Claims, 3 Drawing Sheets

PICTURE DISPLAY DEVICE WITH INTERFERENCE SUPPRESSION MEANS

RELATED CASES

This application is a continuation-in-part of co-pending U.S. application Ser. No. 145,651, filed on Jan. 13, 1988 which is itself a continuation of U.S. application Ser. No. 919,910, filed Oct. 16, 1986, now abandoned. Related co-pending cases by the same inventors are U.S. Ser. No. 154,811, filed Feb. 11, 1988 and Ser. No. 187,614, filed Apr. 28, 1988.

BACKGROUND OF THE INVENTION

The invention relates to a picture display device having a display tube with a rear part which accommodates a device for generating at least one electron beam and a front part which comprises a picture display phosphor screen, said display device also being provided with an electromagnetic deflection unit mounted around the display tube for deflecting electron beams across the display screen and comprising a line deflection coil and a field deflection coil which, when energized, generate magnetic fields having at least a dipole component.

Recently, more stringent standards have been introduced for certain types of picture display devices, notably for monitors, with respect to the magnetic interference field which they may produce around them. Protective shields have sometimes been used in picture display devices such as, for example, a metal cone envelope for the combination of display tube and deflection unit, but such protective shields are intended to inhibit the influence of external fields on the display device rather than reducing magnetic interference fields generated by the picture display device. An important source of magnetic interference fields is the line deflection coil, because it is operated at radio frequency currents (frequencies in the range of 10 to 100 kHz) as contrasted to the field deflection coil. It is impossible to design a satisfactorily operating deflection coil that produces no stray field. If the stray field were to be eliminated by means of a protective shield, such a shield would only be effective if the combination of display tube and deflection unit were also shielded on the display screen side.

SUMMARY OF THE INVENTION

It is an object of the invention to comply with the required radiation standards without using shielding means. In according to the invention. This object is realized in that a picture display device of the kind described in the opening paragraph is provided with an interference suppression coil system which is oriented in such manner and in operation is energizable in such a manner that, measured at a predetermined distance from the picture display device, at least the strength of the local magnetic dipole field is below a desired standard.

The invention is based on the recognition that for the interference suppression of magnetic fields at a long distance from the interfering source (distances of, for example, more than 3 m) it is sufficient to compensate the dipole component only. Deflection units also produce higher order multi-pole (for example, sixpole and tenpole) magnetic deflection field components, but their strength decreases much more rapidly as the distance increases, than does the strength of the dipole component so that their contributions at a distance of approximately 50 cm are already negligible. The magnetic dipole moment of an interfering source can be compensated by adding a current loop having the opposed dipole moment. This dipole moment can be obtained by energizing one coil whose turns are substantially located in one flat plane (a current loop) and which has the required number of turns, the required correct surface area and the required correct orientation. The fact that the spatial position of the compensating dipole moment deviates from that of the deflection unit (which is in the tube) makes little difference at a large distance (>3 m). It is true that the higher order field components produced by the differences in dipole moment position are clearly present at a distance of, for example, 50 cm, but they decrease much more rapidly with an increasing distance than the strength of the dipole component. Energizing may be effected by arranging the interference coil in series with or parallel to the line deflection coil.

The interference coil should preferably cover a surface area which is as large as possible. The larger the surface area the less energy there will be required to generate a desired magnetic dipole moment. A surface area of 1 to 10 $dm^2$ has been found particularly suitable in practice.

The number of turns of the interference suppression coil may be small (less than 10). In many cases 2 to 6 turns may suffice.

An embodiment of a device according to the invention is characterized in that two interference suppression coils are provided symmetrically relative to the plane of symmetry of the line deflection coil on the outer surface of the rear part of the display tube.

An embodiment with which it is also possible to reduce the field at distances of approximately 50 cm is characterized by two interference suppression coils which are provided symmetrically relative to the plane of symmetry of the line deflection coil on the outer side of the deflection unit, which coils are kinked and may have one or more turns which traverse within the coil circumference (at the area of the kink).

BRIEF DESCRIPTION OF THE DRAWINGS

Some embodiments of the invention will now be described with reference to the drawings.

DETAILED DESCRIPTION OF THE INVENTION

Figure 1A:
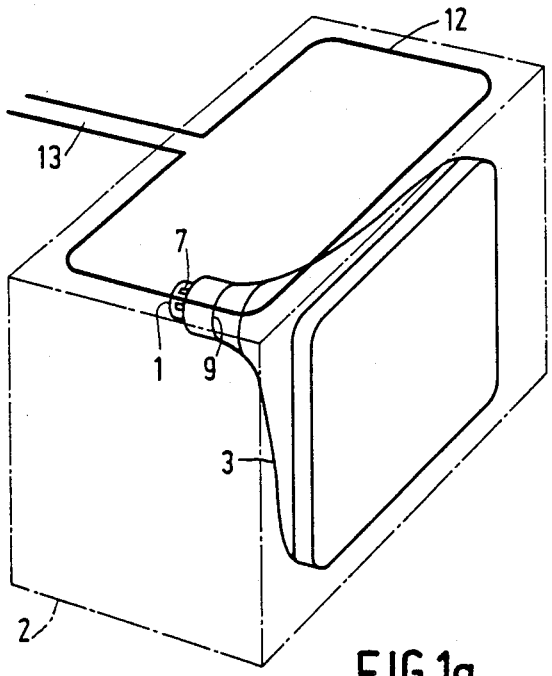
FIG. 1*a* is a perspective elevational view of a picture display device provided with an interference suppression coil according to the invention.

FIG. 1*a* is a perspective elevational view of a combination of a deflection unit and a display tube of the type mentioned in the opening paragraph, placed in a cabinet 2, and is provided with interference suppression means according to the invention. For clarity's sake all details which are unimportant for understanding the invention have been omitted.

The display tube has a cylindrical neck 1 and a truncated cone 3 the widest part of which is present on the front side of the tube and comprises a display screen (not shown).

Figure 1B:
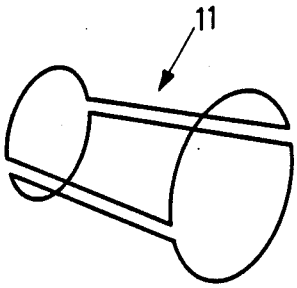
FIG. 1*b* diagrammatically shows a line deflection coil.

The display screen comprises phosphors which upon impingement by electrons, luminesce in a predetermined color. The rear part of the neck 1 accommodates an electron gun system 7 (shown diagrammatically). At the area of the transition between the neck 1 and the cone 3 a deflection unit 9 diagrammatically shown is provided on the tube which unit comprises two field deflection coils (not shown) and two line deflection coils 11 for deflecting the electron beams in a horizontal direction. As is diagrammatically shown in FIG. 1*b* the line deflection coils 11 may be, for example, saddle coils through which a sawtooth current having a frequency of between 10 and 100 kHz flows in the operating condition, (for example, at a frequency of approximately 64 kHz). Generally, the line deflection coils 11 are surrounded by an annular core element of soft magnetic material (not shown), the so-called yoke ring.

Figure 2:
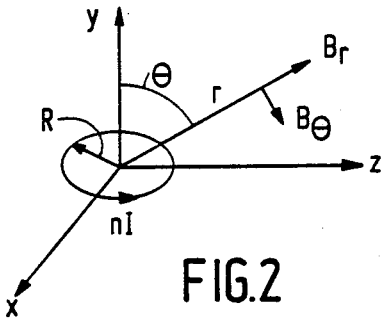
FIG. 2 shows a system of axes in which a current loop is drawn.

When the radiation field of a coil having a yoke ring is initially equally large but opposed to that of a coil without a yoke ring, the coil can be assumed for large distances to be a current loop having a given magnetic moment (see FIG. 2).

For a single current loop with current nI on a radius R, the magnetic moment is defined by:

$$M = \pi R^2 nI$$

When the loop lies in the x-z plane, and when the field is measured in this plane (for example, in a position right in front of the coil), only the $B_\theta$ component is to be taken into account. For this there applies that:

$$B_\theta = \mu_o M / 4\pi z^3 \quad (1)$$

When the single current loop is replaced by a ring shaped coil having a radius of 4 cm and with n=100 turns at I =2A, M becomes $\approx 1$ Am$^2$.

The field $B_\theta$ in the center of such a coil cannot be calculated with the aid of the above-mentioned formula: for $B_{74}$ there applies that:

$$B_\theta = \mu_o nI/2r = 31.4 \text{ Gauss.}$$

For a coil with a yoke ring this would result in approximately the double value, which is in fact approximately the field of a practical deflection coil.

Based on formula (1) the line deflection coil field at 1 m distance is:

$$B_\theta(1 \text{ m}) = \mu_o/4\pi = 10^{-7} \text{ tesla} = 1 \text{ m Gauss.}$$

This radiation field can be compensated with the aid of an auxiliary loop current having a low nI-value and a large radius such that the magnetic moment is the same as that of the coil itself.

When the radius $R_c$ of the compensation loop is 20 cm, and the number of turns is $n_c$, compensation can be found with $$n_c I / nI = (R/R_c)^2 = 1/25.$$

Hence for $n_c$=4 turns. In this manner a reduction of 40 dB can be realized, for example, at a distance of 3 m and more from the radiation source.

Based on the above-mentioned principle an interference suppression coil 12 is built in the cabinet 2 of the combination of display tube and deflection unit of FIG. 1*a*. the coil can be simply mounted, for example, against the upper surface of the cabinet 2. The interference suppression coil 12 can be connected via connection wires 13 to a suitable supply circuit. It may, for example, be in series with or parallel to the line deflection coil 11.

The orientation of the interference suppression coil 12 is such that the magnetic dipole moment generated upon current passage through this coil at a predetermined distance (for example, 3 m) compensates the magnetic dipole moment of the interfering component. To this end, the dipole moment of the interference suppression coil should be parallel to and oppositely directed relative to the dipole moment of the interfering component. The interfering component is the line deflection coil in the first place. However, also the line output transformer may generate an interference field and can then be considered as an interfering component. In that case it applies that:

Parallel dipole moments originating from one or more components can be compensated with one current loop. Non-parallel dipole moments can be compensated with one loop when the frequency and the phase of the dipole moments to be compensated are the same.

Figure 3:
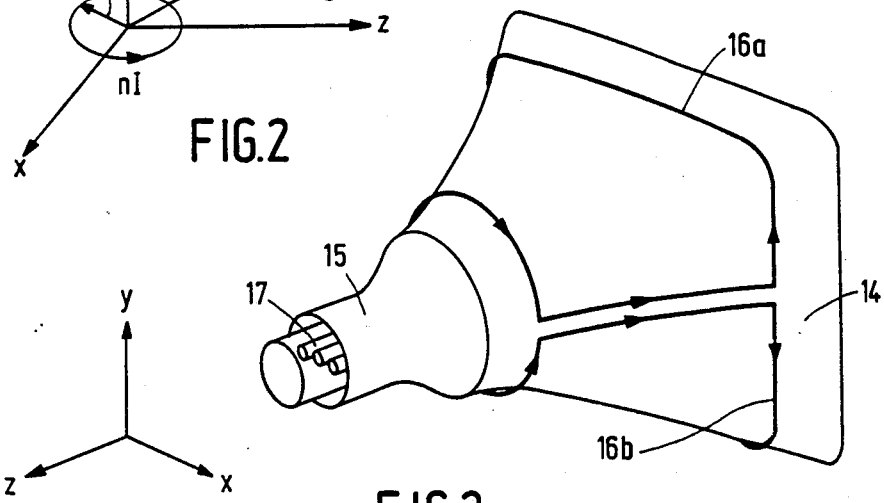
FIG. 3 shows a display on which two interference suppression coils have been provided.

FIG. 3 shows a color television display tube 14 having a deflection unit 15. Color television display tubes are often provided with so-called degaussing coils 16*a*, 16*b*. These degaussing coils 16*a*, 16*b* are provided on the outside of the truncated display tube cone symmetrically relative to the (X-Z) plane of the three electron guns 17. Although the degaussing coils are normally only used as such when the device is switched on, it is in principle possible to energize them during operation in such a manner that they generate a dipole moment at a given distance compensating the dipole moment of the interfering component.

Figure 4:
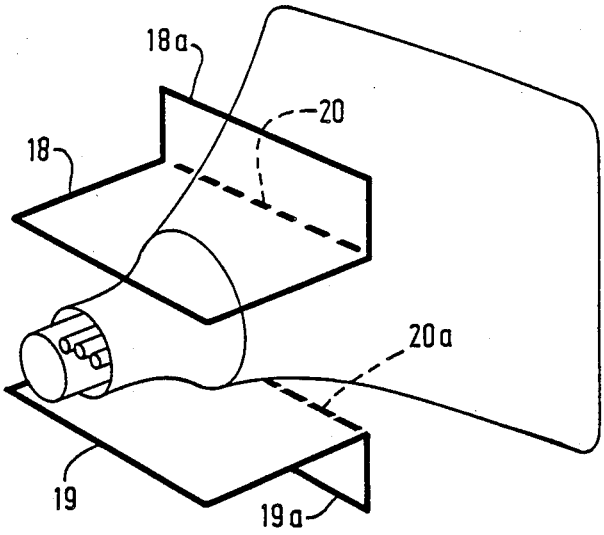
FIG. 4 diagrammatically shows a coil-tube combination with two interference suppression coils having a kink and an intermediate turn, intended to bring about a reduction also at distances from approximately 50 cm.

FIG. 4 shows a coil-tube combination having two "kinked" interference suppression coils, each with flatly positioned portions 18 and 19, respectively, and upright portions 18*a* and 19*a*, respectively. By choosing the number of turns in the upright portion to be different from that in the flatly positioned portion (thus requiring intermediate turns 20 and 20*a*, respectively) an by choosing both the correct current directions and the correct sizes for the flatly positioned portion and the upright portion, a considerable field reduction at distances from approximately 50 cm can be realized. With regard to the correct choice of the current directions, this notably means that upon energization of the interference suppression coil system the currents in the flatly positioned portions flow in the same direction as the currents in the corresponding (axial) portions of the line deflection coils and that the currents in the upright portions flow in a direction which is opposite to the direction of the corresponding (traversal) portions of the line deflection coils.

Figure 5:
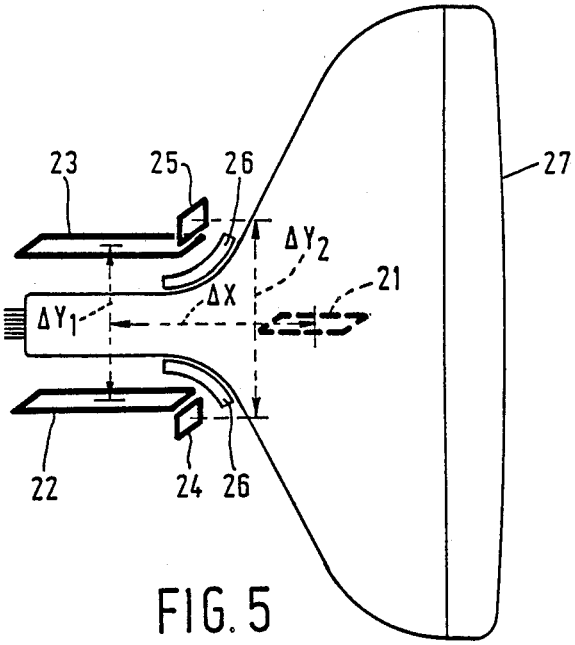
FIG. 5 describes an embodiment which substitutes two coils for each "kinked" coil as described in FIG. 4.

The operation of the coil arrangement of FIG. 4 is elucidated with reference to FIG. 5.

The interfering field of the deflection unit 26 may be roughly considered to be a dipole in the tube 27 (coil 21). The compensation is effected with the coils 22 and 23, which are provided symmetrically relative to the plane of symmetry of the line deflection coil on the deflection unit 26. However, due to the distance $\Delta Y$ between the coils 22 and 23 a 6-pole component is produced and a 4-pole component is produced due to the distance $\Delta X$. If the coils 22, 23 are moved forward (in order to reduce $\Delta X$ and hence the 4-pole component), $\Delta Y$ increases and so does the 6-pole component. Therefore $\Delta Y$ remains small; the 6-pole component can be slightly reduced by enlarging the diameter of the coils 22 and 23, which however, results in that $\Delta X$ must increase because the coils cannot project into the tube. Mainly a 4-pole component, proportional to the size of the coil, the current through the coils and the distance $\Delta Y_2$ is generated with the two vertical coils 24 and 25. A good combination of coil sizes and current intensities can be used to neutralize the 4, 6 and also 8-pole components.

Figure 6:
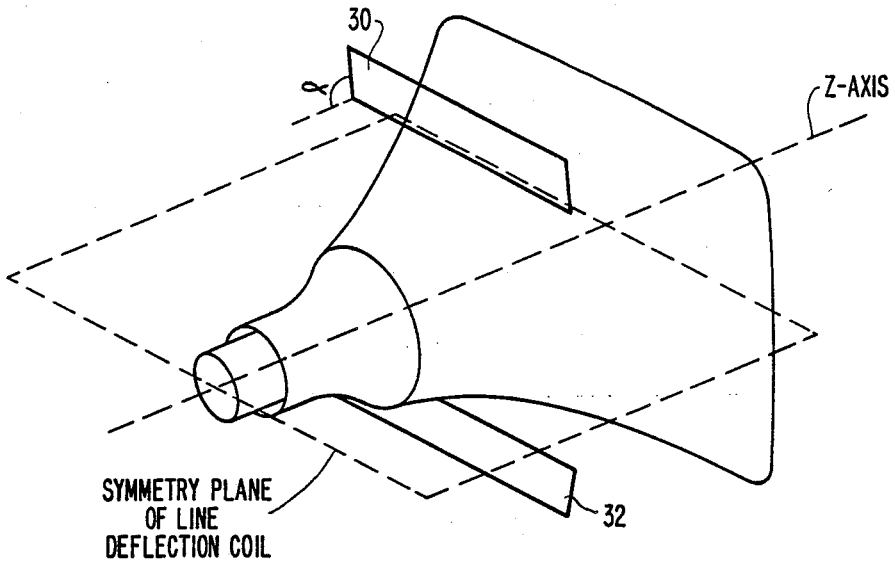
FIG. 6 describes a further embodiment in which each of the "kinked" coils is replaced by a coil which is tilted relative to the plane of symmetry of the line deflection coil.
Figure 6A:
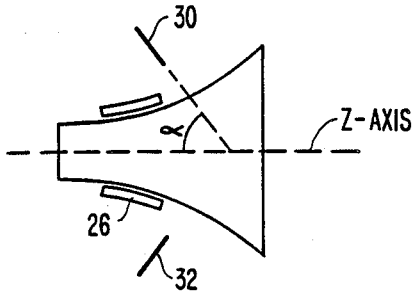
FIG. 6*a* is a side view of FIG. 6.

FIG. 6 describes an embodiment of the invention wherein the "kinked" coils of FIG. 4 and the horizontal and vertical coils, 22-25, of FIG. 5, are replace by "tilted" coils, 30 and 32. Coils 30 and 32 are disposed symmetrically relative to the plane of symmetry of the line deflecting coil, 26, as shown in FIG. 6*a*, in order to produce a multi-pole magnetic field having, for example, a 2 pole component (the strength of which depends on the coil area) and a 4 pole component (the strength of which depends on the angle $\alpha$).

Thus, the invention makes it possible to compensate the magnetic stray fields of a device comprising a number of directly interfering sources (line output stage (line) deflection coil) and a number of indirect sources ("reflectors", base plates) with the aid of an interfering suppression coil having a limited number of turns and a given diameter.

By choosing the number of turns to be low and the diameter to be large the following conditions can always be satisfied:

1. The magnetic dipole moment vector is equal to the sum of the dipole moments of all direct sources in the device;

2. The load on the supply and the interference on the components in the device itself, notably on the (line) deflection coil, is sufficiently small.

We claim:

1. A picture display device having a display tube with a rear part which accommodates a device for generating at least one electron beam and a front part which comprises a display phosphor screen, said display device also being provided with an electromagnetic deflection unit mounted around the display tube for deflecting electron beams across the display screen and including a line deflection coil and a field deflection coil which, when energized, generate magnetic interference fields having at least a dipole component and a quadrupole component, comprising an interference suppression coil system which is orientated, in such a manner, and in operation is energizable in such a manner, that, measured at a predetermined distance from the display device, both the strength of the dipole component and the strength of the quadrupole component are below a desired standard, wherein the interference suppression coil system comprises at least two interference suppression coils which are provided symmetrically relative to the plane of symmetry of the line deflection coil on the outer side of the deflection unit

2. A picture display device as claimed in claim 1, wherein the interference suppression coil system comprises two interference suppression coils which are disposed symmetrically relative to the plane of symmetry of the line deflection coil on the outer side of the deflection unit and are positioned to produce when energized, a magnetic field which has at least a dipole component and a quadrupole component.

3. A picture display device as claimed in claim 1, wherein the interference suppression coil system comprises a pair of coils which with respect to a plane parallel to the display screen have backwardly tilted positions.

4. A picture display device as claimed in claim 1, wherein the interference suppression coil system comprises a first pair of coils which lie in planes which are substantially parallel to the symmetry plane of the line deflection coil, and a second pair of coils which lie in planes which are substantially normal to the symmetry plane of the line deflection coil.

* * * * *